US007199687B2

(12) United States Patent
Maruhashi et al.

(10) Patent No.: US 7,199,687 B2
(45) Date of Patent: Apr. 3, 2007

(54) SOLENOID TYPE DRIVE AND STARTER USING THE SAME

(75) Inventors: Yasuhiko Maruhashi, Tokyo (JP); Rikio Goto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 45 days.

(21) Appl. No.: 10/631,772

(22) Filed: Aug. 1, 2003

(65) Prior Publication Data

US 2004/0056743 A1 Mar. 25, 2004

(30) Foreign Application Priority Data

Aug. 1, 2002 (JP) ..... 2002-224411

(51) Int. Cl.
*H01H 67/02* (2006.01)

(52) U.S. Cl. ..... 335/131; 335/193; 335/259; 335/264; 335/265; 335/271; 335/277; 335/279

(58) Field of Classification Search ..... 335/126, 335/127, 131, 255, 259, 261–267, 279–281, 335/193, 257, 271, 277; 290/28, 38 R, 48
See application file for complete search history.

(56) References Cited

U.S. PATENT DOCUMENTS

| | | | | |
|---|---|---|---|---|
| 2,411,778 A | * | 11/1946 | De Wilde | 335/264 |
| 3,713,059 A | * | 1/1973 | Tada | 335/259 |
| 3,815,060 A | | 6/1974 | Turnbull | |
| 4,637,267 A | | 1/1987 | Mazzorana | |
| 4,825,180 A | | 4/1989 | Miyaji et al. | |
| 5,126,583 A | | 6/1992 | Isozumi et al. | |

FOREIGN PATENT DOCUMENTS

| | | |
|---|---|---|
| EP | 0643411 A | 3/1995 |
| JP | 61-24578 U | 2/1986 |
| JP | 1-137505 U | 9/1989 |
| JP | 08-319926 | 12/1996 |
| JP | 10-159693 | 6/1998 |
| JP | 11-230014 | 8/1999 |

OTHER PUBLICATIONS

Japanese Office Action (notice of rejection) dated May2, 2006 with an English translation (four (4) pages).
Japanese Office Action date Oct. 25, 2005.
European Search Report issued Sep. 25, 2006, in corresponding EP application 03 01 6661.

* cited by examiner

*Primary Examiner*—Ramon M. Barrera
(74) *Attorney, Agent, or Firm*—Crowell & Moring LLP

(57) ABSTRACT

A solenoid type device as a magnetic switch of a starter 10 comprises an exciting coil 3*f* that is energized and generates magnetic force, a plunger 3*a* that is a moving core which is a part of the magnetic circuit, and a fixed core 3*j* that faces the moving core and is also a part of the magnetic circuit. The moving core plunger 3*a* is divided into concentrically the first plunger 31 and the second plunger 32*a*. This configuration allows the second plunger 32*a* to be attracted first and then the first plunger 31*a* to be attracted.

Thereby, it is possible to make a small and light magnetic switch while ensuring that the magnetic switch maintains sufficient attraction force as well as to increase reliability of operations of the magnetic switch even when battery voltage is low.

17 Claims, 4 Drawing Sheets

SOLENOID TYPE DRIVE AND STARTER USING THE SAME

BACKGROUND OF THE INVENTION

1. Field of the Invention

The present invention relates to a solenoid device, for example used in a magnetic switch, and also relates to a starter that uses the magnetic switch.

2. Prior Art

The conventional starter, as disclosed in Japanese application patent Laid-open Publication No. Hei 11-230014, for example, uses the attraction force of a magnetic switch to move a pinion in the direction of the rotation shaft and engage a motor's output shaft with an engine's ring gear, thereby starting an engine via the motor's rotational driving force. When a key switch is turned on, a battery energizes the magnetic switch which attracts a plunger, thereby closing the normally-open internal contact of the magnetic switch. When the magnetic switch's normally-open internal contact is closed, the motor is energized causing its rotational driving force to be transmitted to the engine via a roller clutch, pinion and ring gear so as to start an engine.

3. Problems to be Solved by the Invention

Lately, demand for smaller electrical components installed in vehicles has been increasing and accordingly, studies have been made to reduce the size of the motor used for starters. However, the reduction of the size of the magnetic switch has not been studied enough yet, because as the size of the magnetic switch is reduced without consideration, the attraction force of the magnetic switch's plunger is also reduced. In addition, if the size of a magnetic switch is merely reduced, when battery voltage is low, the small magnetic switch may not work reliably, resulting in unreliable engine start.

SUMMARY OF THE INVENTION

The purposes of the present invention are to create a small and light magnetic switch while ensuring sufficient attraction force of the magnetic switch as well as to provide a highly reliable solenoid device and starter which accurately operates even when battery voltage is low.

[Means for Solving the Problems]

(1) To achieve the above purposes, the present invention provides the following solenoid device. The solenoid type drive comprising an exciting coil that is energized to generate magnetic force, a moving core that is a component of a magnetic circuit and is movable in the axial direction, and a fixed core that is located opposite the moving core and is also a component of the magnetic circuit. Wherein, the moving core and the fixed core are constructed so that the moving core comes in contact with the fixed core while remaining a partial small gap between them when the moving core was attracted to the fixed core by energizing the exciting coil. At least one of the moving core and the fixed core has mechanism which operates so as to decrease the partial small gap.

This configuration makes it possible to create a small and light magnetic switch while ensuring sufficient attraction force of the magnetic switch and also to increase reliability of operations of the magnetic switch even when battery voltage is low. The details are described in the Preferred Embodiments.

(2) Further to achieve the above purposes, the present invention provides the following solenoid device. The solenoid type drive comprises an exciting coil that is energized and generates magnetic force, a moving core that is a component of a magnetic circuit and is movable in the axial direction, and a fixed core that is located opposite the moving core and is also a component of the magnetic circuit. Wherein, at least one of the moving core and the fixed core comprises two or more core elements. The moving core reaches to the fixed core first at one side of the core elements when the moving core is attracted to the fixed core by energizing the exciting coil, and then reaches to the fixed core at the other side of the core elements.

(3) In above configuration, for example, the core elements, that constitute at least one of the moving core and the fixed core, are concentrically formed.

(4) The starter that applied the solenoid device of the above item (1) is constituted as follows.

The starter comprises a motor that is mounted to an engine and generates a rotational driving power, a power transmission apparatus that transmits the motor's rotational driving power to the engine, and a solenoid switch that comprises an exciting coil which is energized and generates magnetic force, a moving core which is a component of a magnetic circuit and is movable in the axial direction, and a fixed core which is located opposite the moving core and is also a component of the magnetic circuit. The power transmission apparatus is operated, by action of the solenoid switch, and the motor is energized. Wherein, the moving core and the fixed core are constructed so that the moving core comes in contact with the fixed core while remaining a partial small gap between them when the moving core was attracted to the fixed core by energizing the exciting coil. And at least one of the moving core and the fixed core has mechanism which operates so as to decrease the partial small gap.

(5) In the above item (4), preferably, the solenoid switch is equipped with a buffer mechanism for distributing the shock, which arises when the moving core was magnetically attracted to the fixed core by energizing the exciting coil, in two or more times.

(6) In the above item (5), preferably, the buffer mechanism is constructed by the moving core divided into two or more core concentric elements, and the core elements can relatively displace each other in the moving direction of the moving core.

(7) In the above item (6), preferably, the moving core elements are arranged so that their end surfaces opposite to the fixed core have a difference in level in the axial direction.

(8) In the above item (6), preferably, the moving core is equipped with a shock absorber using an elastic body that elastically deforms as the relative displacement of the core elements.

(9) In the above item (4), the buffer mechanism is constructed by the fixed core divided into two or more core elements, and the core elements can relatively displace in the moving direction of the moving core.

(10) In the above item (9), preferably, the fixed core elements are arranged so that their end surfaces opposite to the fixed core have a difference in level in the axial direction.

(11) In the above item (9), preferably, the fixed core is equipped with a shock absorber using an elastic body that elastically deforms as the relative displacement of the core elements.

(12) To achieve the above purposes, the present invention provides a starter as follows. The starter comprises a motor that is mounted to an engine and generates a rotational driving power, a power transmission apparatus that transmits the motor's rotational driving power to the engine, and a solenoid switch. The solenoid switch comprises an exciting coil which is energized and generates magnetic force, a moving core which is a component of a magnetic circuit and is movable in the axial direction, and a fixed core which is located opposite the moving core and is also a component of the magnetic circuit. Wherein, at least one of the moving core and the fixed core comprises two or more concentric core elements. The moving core reaches to the fixed core first at one side of the core elements when the moving core is attracted to the fixed core by energizing the exciting coil, and then reaches to the fixed core at the other side of the core elements.

(13) To achieve the above purposes, the present invention provides a starter as follows. The starter comprises a motor that is mounted to an engine and generates a rotational driving power, a power transmission apparatus that transmits the motor's rotational driving power to the engine, and a solenoid switch that comprises an exciting coil which is energized and generates magnetic force, a moving core which is a component of a magnetic circuit and is movable in the axial direction, and a fixed core which is located opposite the moving core and is also a component of the magnetic circuit. Wherein at least one of the moving core and the fixed core is divided concentrically into two or more core elements. The distance (L2) between the moving core and the fixed core at one side of the core elements, at the time of non-energizing the exciting coil, is made shorter than a distance (L1) between the moving core and the fixed core at the other side of the core elements.

DESCRIPTION OF THE PREFERRED EMBODIMENTS

Hereafter, with reference to FIGS. 1 through 4, the construction of a starter and a solenoid switch (solenoid device) used for the starter according to a first embodiment of the present invention will be described.

Figure 1:
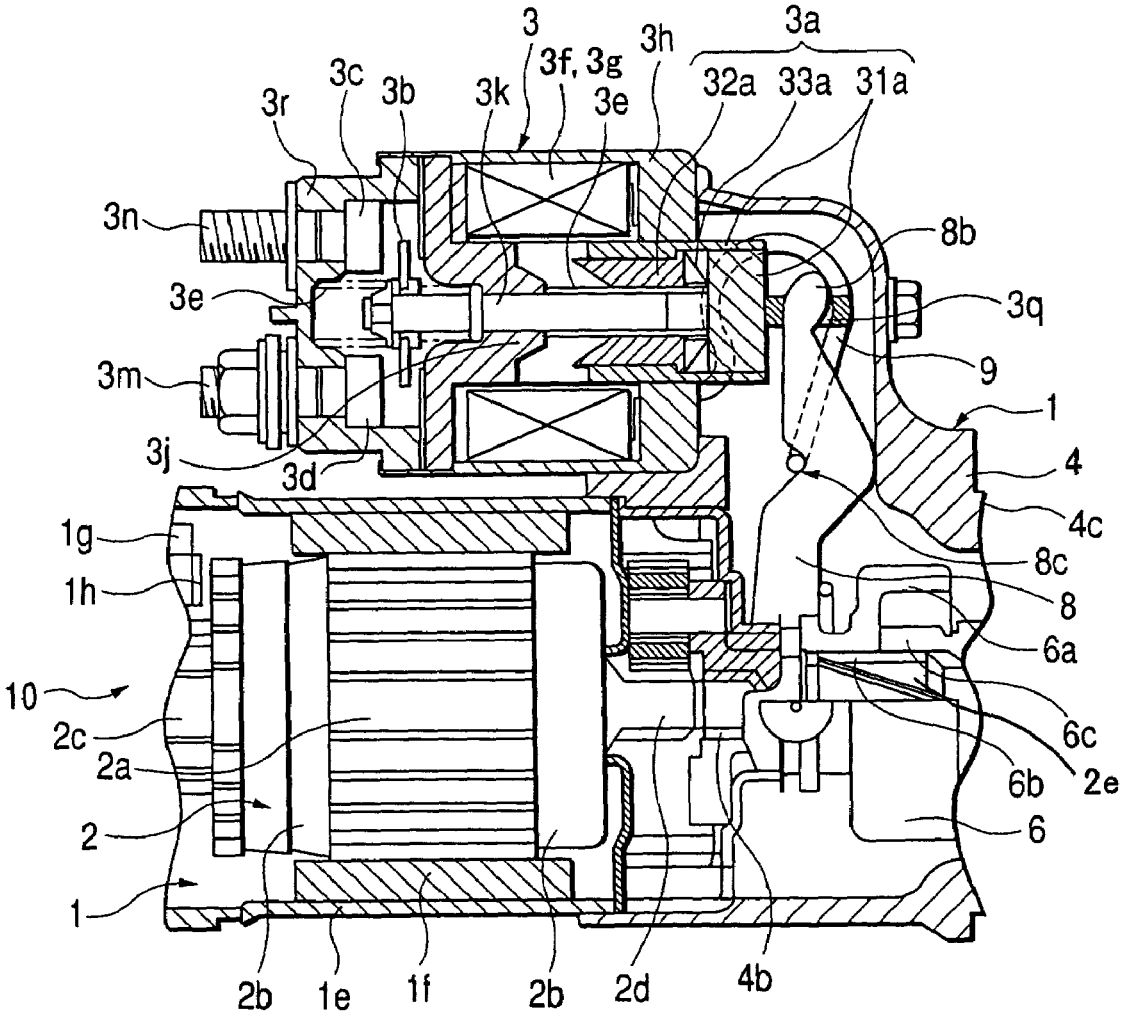
FIG. 1 is a schematic cross-sectional view that illustrates a starter according to a first embodiment of the present invention.
Figure 2:
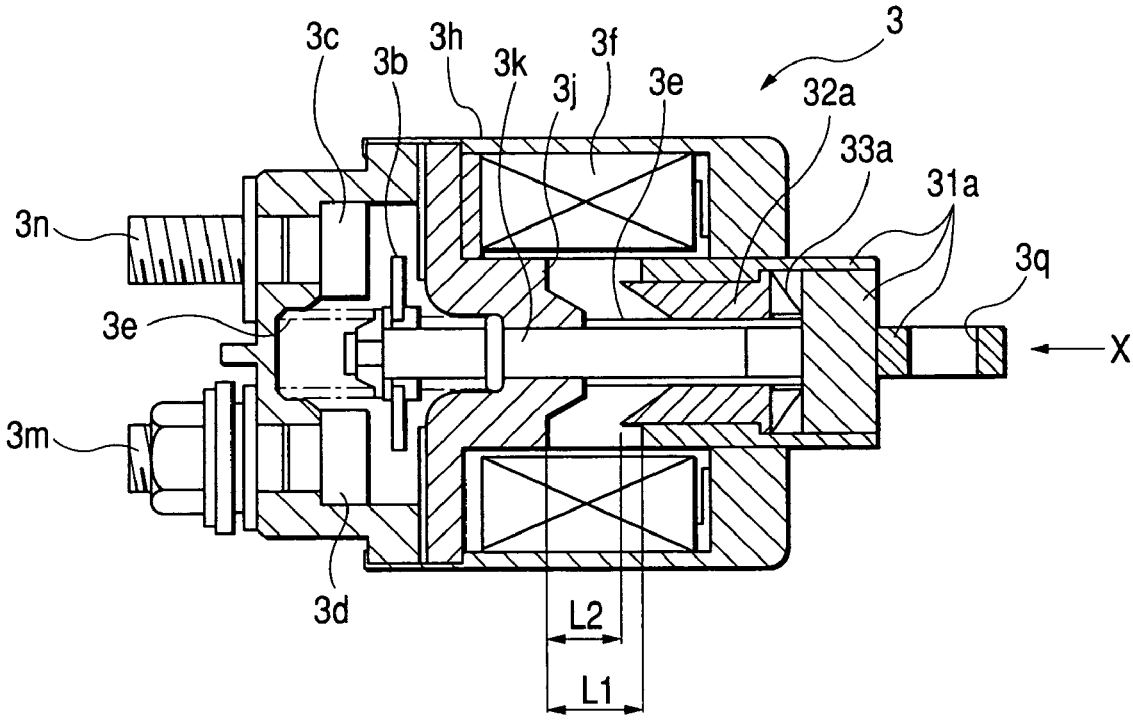
FIG. 2 is a schematic cross-sectional view that illustrates a magnetic switch used for a starter according to a first embodiment of the present invention.
Figure 3:
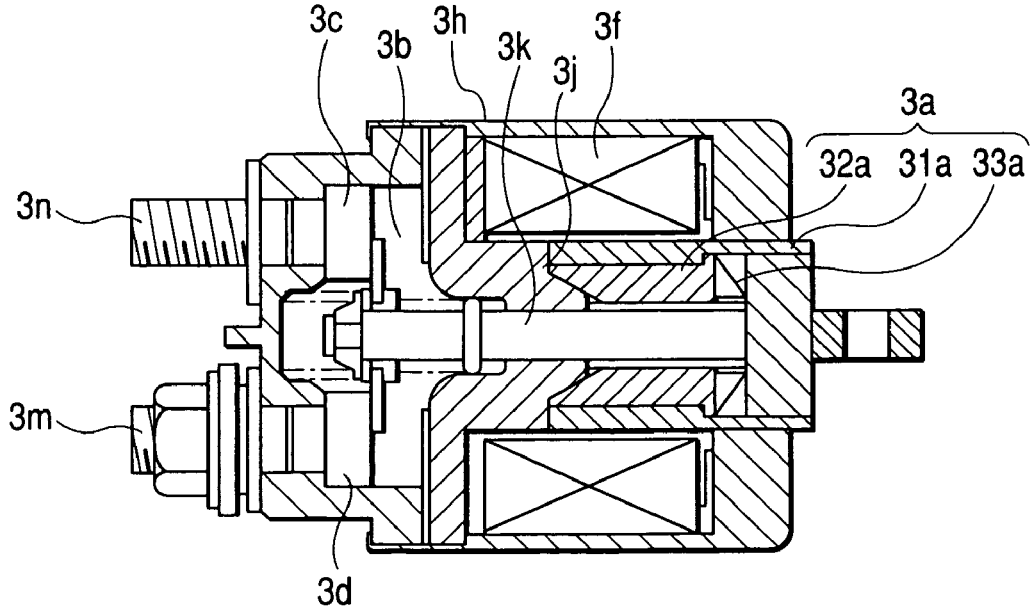
FIG. 3 is an explanatory drawing that shows the operations of a magnetic switch used for a starter according to a first embodiment of the present invention.
Figure 4:
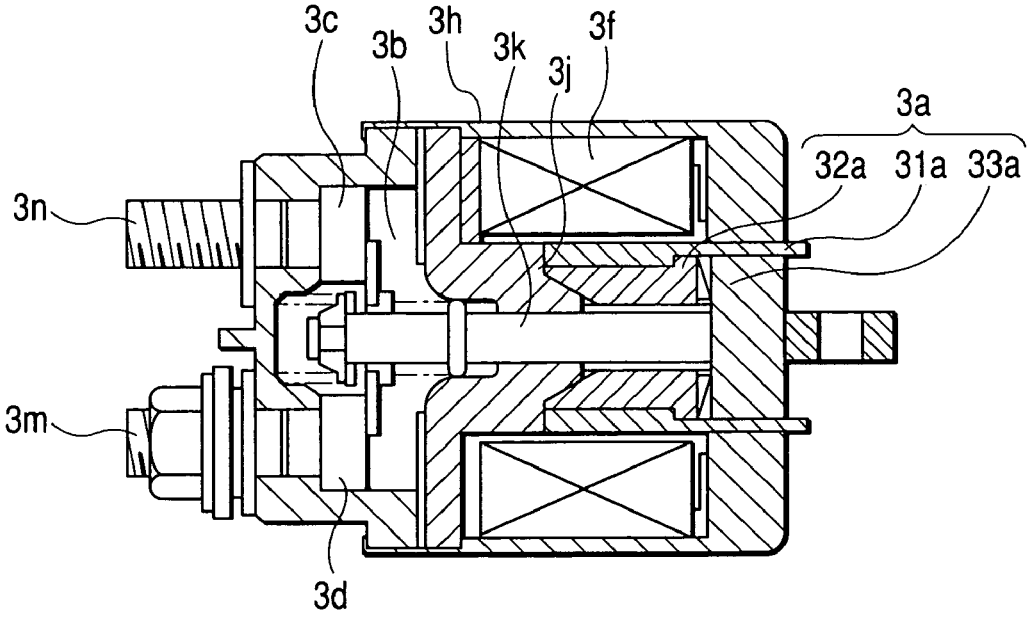
FIG. 4 is an explanatory drawing that shows the operations of a magnetic switch used for a starter according to a first embodiment of the present invention.

FIG. 1 is a schematic cross-sectional view that illustrates a starter according to the first embodiment of the present invention. FIG. 2 is a schematic cross-sectional view that illustrates the magnetic switch used for the starter according to the first embodiment of the present invention. FIGS. 3 and 4 are explanatory drawings that show the operations of the magnetic switch used for the starter according to the first embodiment of the present invention.

A starter 10, as shown in FIG. 1, is a starter that operates by electrical power supplied from a battery installed in an automobile, and generates a rotational driving power for starting an internal-combustion engine. Functionally, the starter 10 comprises a rotational driving force generating section, a rotational driving force transmitting section, and a rotational driving force transmission controlling section. That is, the rotational driving force generating section is composed of a motor 1 that generates a rotational driving force for starting an engine. The rotational driving force transmitting section comprises a roller clutch 6 and pinion (not shown in Figs.) that transmit the rotational driving force of the motor 1 to the engine's ring gear. The rotational driving force transmission controlling section is composed of a magnetic switch 3 used as a power source to move the roller clutch 6 and the pinion in the direction of the rotation shaft and also turns on and off the power supply to the motor 1.

The motor 1 and the magnetic switch 3 are mounted to a front bracket 4 by a fixing means such as bolts. The roller clutch 6 and pinion are rotatably supported inside the front bracket 4.

A yoke 1*e* and a field stator (field pole) 1*f* are mounted to the motor 1. The cylindrical yoke 1*e* is an outer casing of the motor 1. The field stator (field pole) 1*f* is located on the inner-periphery side of the yoke 1*e*, completing a magnetic circuit together with the yoke 1*e*.

On the inner-periphery side of the field stator 1*f*, a rotor 2 (armature) is rotatably supported via a predetermined gap. The rotor 2 has a magnetic core (rotor core) 2*a*. The magnetic core 2*a* is a component of the magnetic circuit. On the outer periphery of the magnetic core 2*a*, multiple slots have been formed. An armature coil (rotor winding) 2*b* has been inserted into each slot. At one end of the magnetic core 2*a*, a commutator 2*c* which is electrically connected to the armature coil 2*b* is installed. The magnetic core 2*a* and the commutator 2*c* are mounted to an output shaft 2*d*. At one end (opposite side from the commutator 2*c*) of the output shaft 2, the roller clutch 6 and pinion are mounted so that they are axially movable. Both ends of the output shaft 2*d* are rotatably supported by a bearings 4*b* and another bearing (not shown in FIG.s).

Plural brushes 1*g* slidably come in contact with the cylindrical outer periphery of the commutator 2*c*. The brushes 1*g* consist of plus-side brush that supply electrical power from a battery to the commutator 2*c* and minus-side brush that discharge electrical power, which is supplied to the armature coil 2*b* via the plus-side brush and the commutator 2*c*, to the vehicle's earth side. One end of a lead wire (not shown) that conducts electrical power is connected to the each brush 1*g*. At one end (commutator 2*c* side) of the yoke 1*e*, there is provided a brush holder 1*h* that holds each brush 1*g* and applies pressure to it so that each brush 1*g* comes in contact with the cylindrical outer periphery of the commutator 2. Furthermore, at one end (commutator 2*c* side) of the yoke 1*e*, there is provided a rear bracket (also called rear cover) that covers and mounts the brush holder 1*h*. A bearing that supports one end of the output shaft 2*d* is disposed at the rear bracket.

The output shaft 2*d* of the rotor 2 is rotatably supported by a bearing 4*b* located at the nose 4*a* of the front bracket 4 and a rear bracket's bearing. The roller clutch 6 and pinion are slidably mounted to the output shaft 2*d*.

The magnetic switch 3 controls the supply of electrical power to the motor 1 as well as controls the transmission of the rotational driving force to the engine's ring gear. The magnetic switch 3, which is juxtaposed outside the motor 1, turns on and off the motor 1 and also exerts a driving force to move the roller clutch 6 and pinion in the direction of the rotation shaft.

A coil case 3*h*, which is a cylindrical frame body, is a part of the magnetic circuit of the magnetic switch 3. Inside the coil case 3*h*, there are provided an attraction coil (winding) 3*f* and a holding coil (winding) 3*g* that are excited by the supply of electrical power. On the internal periphery of the attraction coil 3*f* and the holding coil 3*g*, there is provided a plunger (moving core) 3*a* as a movable member which can move axially. At the rear end (on the left in FIG. 2) of the internal periphery of the attraction coil 3*f* and the holding coil 3*g*, a boss (fixed core) 3*j* that is a part of the magnetic circuit is located. At the axial center of the boss 3*j*, a movable shaft 3*k* is installed so that it can slide in the axial direction.

At the rear end (on the left in FIG. 2) of the movable shaft 3*k*, a movable contact 3*b* that opens and closes the energizing circuit to the motor 1 is mounted. At a rear end position of the magnetic switch 3 that faces the movable contact 3*b*, a battery-side fixed contact 3*c* and a motor-side fixed contact 3*d*, which can be contacted and detached to the movable contact 3*b* and open and close the energizing circuit to the motor 1, are provided in a contact case 3*r*. A battery terminal 3*n* that is connected to the battery has been integrated into the battery-side fixed contact 3*c*. The motor terminal 3*m* connected to the motor 1 via a lead wire (not shown in FIG.s) has been integrated into the motor-side fixed contact 3*d*. Furthermore, at the rear end of the magnetic switch 3, there is provided a switch terminal (not shown in FIG.s) that is electrically connected to one end of both the attraction coil 3*f* and the holding coil 3*g* and is connected to the battery via a key switch. The motor terminal 3*m*, battery terminal 3*n* and switch terminal protrude from the rear end of the contact case 3*r* of the magnetic switch 3.

The plunger 3*a* of the magnetic switch 3 is given the load of a spring 3*e*. The spring load of the spring 3*e* functions in such a way that the plunger 3*a* and the shift lever 8 return to their original position (on the right in FIG. 2) after the engine has started.

A square-shaped hole section 3*q* is located in the projection located at the front end (on the right in FIG. 2) of the plunger 3*a*. The square-shaped hole section 3*q* protrudes from an end of the magnetic switch 3 in the pinion-side direction. The plunger engaging section 8*b* of the shift lever 8 is inserted into and engages with the square-shaped hole section 3*q* of the plunger 3*a*. This mechanism couples the plunger 3*a* and the shift lever 8. A pivot 8*c* is provided in the middle of the shift lever. 8. The pivot 8*c* is engaged with a lever spring 9. The lever spring 9 rotatably supports the shift lever 8 around the pivot 8*c* of the shift lever 8. The lever spring 9 becomes the fulcrum of the shift lever 8 operations, and the spring load of the lever spring 9 functions as a bite-in force that moves the roller clutch 6 and pinion to the ring-gear side when an engine starts. The other end (pinion side) of the shift lever 8 engages with the rear end of the roller clutch 6.

The roller clutch 6 is a power transmission device in which an outer clutch 6*a* is located on the outer-periphery side, an inner clutch 6*c* is located on the inner-periphery side, and a roller and spring are provided inside. The roller clutch 6 is a one-way clutch that transmits a rotational driving force of the motor 1 to the pinion but does not allow the rotational force of the pinion to be transmitted to the motor 1.

The pinion, which has been integrated into the inner clutch 6*c*, is a power transmission apparatus that transmits the rotational driving force of the motor 1, transmitted via the roller clutch 6, to a ring gear. The pinion has been integrated into the roller clutch 6 so that it can move and rotate on the output shaft 2*d* of the rotor 2. On the outer periphery of the output shaft 2*d*, there is provided a helical spline 2*e* that engages with a helical spline 6*b*, which is located at the rear end of the internal periphery of the outer clutch 6*a*, so that the helical spline 2*e* can transmit the rotational driving force of the motor 1 to the roller clutch 6. By means of the helical spline 2*e* of the output shaft 2*d* and the helical spline 6*b* of the roller clutch 6, the roller clutch 6 and the pinion engage with each other so that the roller clutch 6 and pinion slide on the output shaft 2*d* and transmit the rotational driving force.

The roller clutch 6 and the pinion slide in the direction of the output shaft 2*d* by the power (attraction force by the plunger 3*a*) of the magnetic switch 3 via the shift lever 8.

When the pinion engages with the ring gear, the rotational driving force of the motor 1 is transmitted to the engine.

The part 4*c* of the front bracket 4 of the starter 10 is fitted to the starter mounting section of the engine, and the starter 10 is mounted to the engine by bolting the engine through the mounting hole of the flange (not shown in FIG.s) of the front bracket 4.

Next, with reference to FIG. 2, the construction of the plunger (moving core) 3*a* of the magnetic switch 3 used for a starter according to this embodiment will be described.

The plunger 3*a* is a divided structure that comprises the first plunger (core element) 31*a* which forms the outer-periphery side and the second plunger (core element) 32*a* which forms the inner-periphery side, and a dish-like plate spring 33*a* is provided as a shock absorber in the axial direction gap located between the first plunger 31*a* and the second plunger 32*a*.

FIG. 2 illustrates the condition where the attraction coil 3*f* has not been energized. The first plunger 31*a* and the second plunger 32*a* have coaxial construction which allows each plunger to independently slide along the axial direction.

Assuming that the distance (gap) between the end surface of the first plunger 31*a* and the boss (fixed core) 3*j* is L1 and the distance (gap) between the end surface of the second plunger 32*a* and the boss (fixed core) 3*j* is L2, there is a relationship where L1>L2. Distance L2 is a gap (stroke) to the point at which the plunger 3*a* is attracted due to a magnetic force generated by the energized attraction (exciting) coil 3*f* and comes in contact with the boss 3*j*. The distance (stroke) L1 is necessary for the shift lever 8 to rotate and for the roller clutch 6 and pinion to engage with the ring gear to start the engine. Distance L2 between the second plunger 32*a* and the boss 3*j* is made shorter than distance (stroke) L1. As a result, a step equivalent to the difference (L1−L2) occurs between the end surface of the first plunger 31*a* and that of the second plunger 32*a*.

The other end (on the right in FIG. 2) of the first plunger 31*a* engages with the second plunger 32*a* so that the first plunger 31*a* and the second plunger 32*a* move together when the first plunger 31*a* moves in the direction of arrow X (operating direction when power is turned on) due to a magnetic force generated by the energized attraction coil 3*f*. When the first plunger 31*a* reaches to the boss 3*j*, the first plunger 31*a* stops moving, thereby disengaging the first plunger 31*a* from the second plunger 32*a*, which allows only the second plunger 32*a* to move (displace) toward the boss 3*j*.

When the power supply to the attraction coil 3*f* is stopped, the spring 3*e* functions to allow the second plunger 32*a* to move in the opposite direction (on the right in FIG. 2) from the direction of arrow X. At this point in time, the first plunger 31*a* and the second plunger 32*a* are engaged, thereby the first plunger 31*a* is moving in the same direction as the second plunger 32*a*.

Next, with reference to FIGS. 1 and 2, operations of the starter 10 will be described.

When a driver turns on a key switch, not shown, to start an engine of an automobile, electrical power is supplied from the battery, not shown, to the attraction coil 3*f* and the holding coil 3*g* of the magnetic switch 3. Then, the plunger 3*a* is attracted to the boss 3*j* due to a magnetic force generated by the attraction coil 3*f* and the holding coil 3*g*. The plunger 3*a* resists the spring force of the plunger returning spring 3*e* and moves in the rear direction (on the left in FIG. 1). As the result of the movement of the plunger 3*a*, the lever member 8 rotates counterclockwise around the pivot 8*c* which is supported by the lever spring 9. The rotation of the lever member 8 moves the roller clutch 6 and the pinion on the output shaft 2*a* to the ring gear side.

At this point in time, unless both end surfaces of the pinion and the ring gear abut on (contact) each other, the pinion fully engages with the ring gear.

Herein, if both end surfaces of the pinion and the ring gear are abutted, the roller clutch 6 and the pinion stop moving axially; however, the plunger 3*a* continuously moves due to an attraction force bending (elastically deforming) the lever spring 9, thereby moving the movable shaft 3*k*. When a movable contact 3*h* contact on a fixed contact 3*j*, it energizes and rotates the motor 1. This rotational driving power rotates the roller clutch 6 and the pinion, which have been pressed onto the ring-gear side due to the spring force of the lever spring 9 via the lever member 8, and when the contact of both end surfaces of the pinion and the ring gear is released to an appropriate distance for engagement, the spring force of the lever spring 9 pushes the roller clutch 6 and the pinion toward the ring-gear side, thereby engaging the pinion with the ring gear.

Then, the rotational driving force of the motor 1 is transmitted to the engine via the roller clutch 6, pinion, and ring gear, rotating the engine's driving shaft to start the engine.

After the engine starts, when a driver turns off the key switch, not shown, the spring force of the returning spring 3*e* is activated to return the plunger 3*a* to its original position. As a result of the movement of the plunger 3*a*, the movable shaft 3*k* also returns to its original position, causing the movable contact 3*h* to separate from the fixed contact 3*j*, thereby stopping the power supply to the motor 1 and stopping the rotation of the motor 1. On the other hand, the lever member 8 engaged with the plunger 3*a* rotates clockwise around the pivot 8*c* which is supported by the lever spring 9, and returns the roller clutch 6 and the pinion to their original position, shown in FIG. 1, which separates the pinion from the ring gear (disengaging the pinion from the ring gear).

Next, with reference to FIGS. 2 through 4, operations of the magnetic switch 3 will be described in detail.

In FIG. 2, when a driver turns on a key switch, not shown, an electric current is supplied from the battery, not shown, to the attraction coil 3*f* and the holding coil 3*g* of the magnetic switch 3. As a result, the plunger 3*a* is attracted toward the boss 3*j* (in the direction of arrow X) due to a magnetic force generated by the attraction coil 3*f* and the holding coil 3*g* and then continues to travel, as shown in FIG. 3, while pushing the movable shaft 3*k*.

At the section facing the movable contact 3*b*, there are provided a battery-side fixed contact 3*c* and a motor-side fixed contact 3*d* which can be contacted and detached to the movable contact 3*b* to open and close the energizing circuit for the motor 1. When the movable contact 3*b*, battery-side fixed contact 3*c*, and the motor-side fixed contact 3*d* come in contact, the electrical power is supplied to the motor 1 and also, as shown in FIG. 4, the plunger 3*a* has moved to the limit of its travel, thereby rotating motor 1.

The attraction force, that affects the plunger 3*a* when the attraction coil 3*f* and the holding coil 3*g* of the magnetic switch 3 are energized, is inversely proportional to the axial direction gap (distance) placed between the plunger 3*a* and the boss 3*j*. Therefore, as the gap becomes smaller, the attraction force becomes greater. As shown in FIG. 2, a gap between the first plunger 31*a* and the boss 3*j* is L1, and a gap between the second plunger 32*a* and the boss 3*j* is L2. In this case, a greater attraction force affects the plunger 3*a* in comparison with the case in which the plunger 3*a* is not a divided structure and a gap between the plunger 3*a* and the boss 3*j* is evenly L1.

Therefore, by using a starter according to this embodiment, it is possible for the number of turns of the attraction coil 3*f* and the holding coil 3*g* of the magnetic switch 3 to be reduced thereby reducing the size of the magnetic switch 3. Furthermore, because the attraction force can be made greater, the starter can reliably work even when the battery voltage is low.

Moreover, in a conventional magnetic switch, when a plunger 3*a* is attracted to and comes in contact with a boss 3*j*, kinetic energy of total mass M of the plunger 3*a* affects the boss 3*j* all at once, which generates a great impact force. This impact force is transmitted to the battery-side fixed contact 3*c* and the motor-side fixed contact 3*d* via the boss 3*j* and the contact case 3*r*. Accordingly, vibration caused on the battery-side fixed contact 3*c* and the motor-side fixed contact 3*d* generates a phase difference among those contacts and the movable contact 3*b* that is in contact with those contacts, thereby causing the battery-side fixed contact 3*c*, motor-side fixed contact 3*d* and movable contact 3*b* to intermittently come in contact with one another (chattering). This chattering condition generates arc among the contacts, and the generated arc heat will melt the battery-side fixed contact 3*c*, motor-side fixed contact 3*d* and movable contact 3*b*, which may result in the welding together of those contacts. If this occurs, the condition results in a continuous electrical current flow through the motor 1, which continuously rotates the motor at a high speed and may eventually damage the motor.

However, in a starter 10 according to this embodiment, the plunger 3*a* of the magnetic switch 3 is a division structure that consists of the first plunger 31*a* which forms the outer-periphery side and the second plunger 32*a* which forms the inner-periphery side so that an axial direction step (a difference in level) is made between both end surfaces of the first plunger 31*a* and the second plunger 32*a*. As a consequence, when the plunger 3*a* operates due to an attraction force, the second plunger 32*a* reaches to the boss 3*j* first (comes in contact with the boss 3*j* first), and then the first plunger 31*a* reaches to the boss 3*j*.

This mechanism twice distributes the impact force generated on the boss 3*j* to reduce vibration generated on the boss 3*i*, thereby reducing vibrational energy transmitted to the battery-side fixed contact 3*c* and the motor-side fixed contact 3*d*. Consequently, it is possible to prevent the occurrence of the intermittent contact condition (chattering) among the above contacts and the movable contact 3*b*. The adoption of the magnetic switch 3 for a starter 10 according to this embodiment will prevent the contacts from intermittently opening and closing (chattering), which prevents the generation of the arc heat and the contacts from being welded together. As a result, it is possible to prevent damage to the motor or power-transmission parts due to continuous electrical current flow after the key switch has been turned off.

As stated above, according to this embodiment, it is possible to increase the attraction force that affects the plunger 3*a* of the magnetic switch 3, thereby making it possible to reduce the size of the magnetic switch 3. It is also possible to make the functioning of the magnetic switch 3 reliable even when the battery voltage is low. Furthermore, the chattering of the magnetic switch 3 will be eliminated, which will improve reliability.

Next, with reference to FIG. 5, the construction of a starter and a solenoid used for the starter, according to a second embodiment of the present invention, will be described. A schematic view of the starter according to this embodiment is the same as that shown in FIG. 1.

Figure 5:
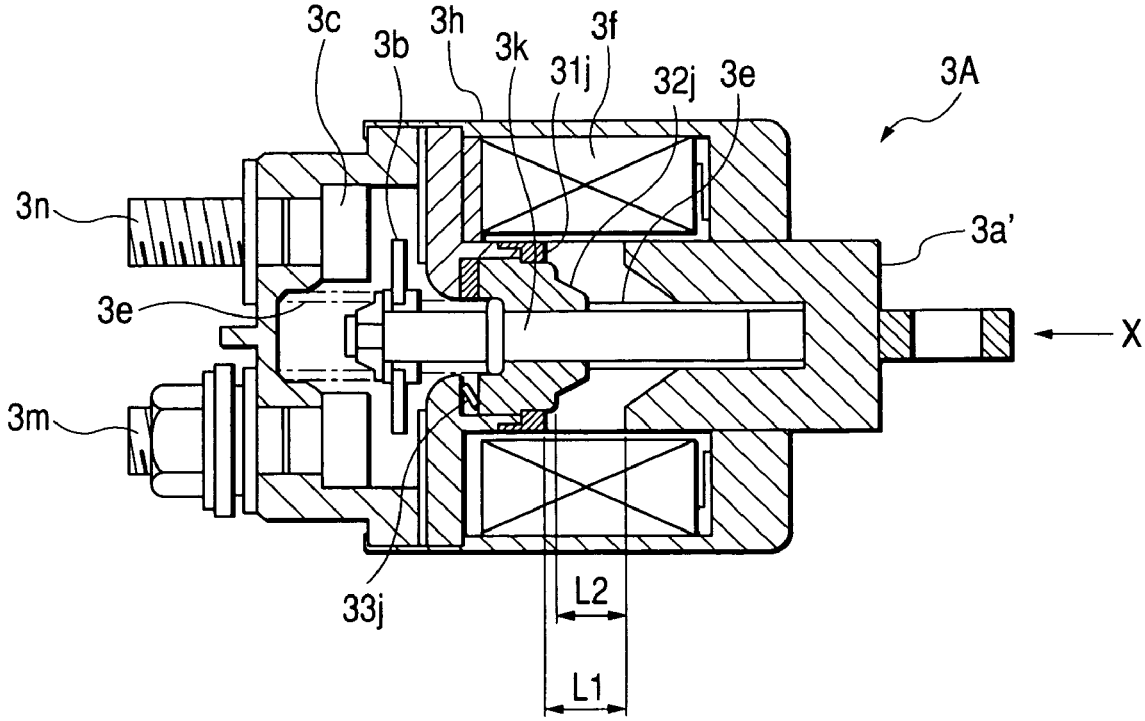
FIG. 5 is a schematic cross-sectional view that illustrates a magnetic switch used for a starter according to a second embodiment of the present invention.

FIG. 5 is a schematic cross-sectional view that illustrates a magnetic switch used for a starter according to a second embodiment of the present invention. Items in FIG. 5 are identical to those in FIG. 2 when the same alphanumeric appears.

The plunger 3*a*' is an all-in-one structure which is different from one, as shown in FIG. 2, that consists of a first plunger 31*a*, second plunger 32*a* and spring 33*a*. However, a boss (fixed core) 3*j* comprises a first boss 31*j*, second boss 32*j* and dish-like plate spring 33*j*. The first boss 31*j* is formed on the outer-periphery side and the second boss 32*j* is formed on the inner-periphery side. Both bosses are formed coaxially. A dish-like plate spring 33*j* is located as a shock absorber in an axial direction gap located between the first boss 31*j* and the second boss 32*j*.

Assuming that the distance between the end surface of the plunger 3*a*' and the second boss 32*j* is L2, and the distance between the end surface of the plunger 3*a*' and the first boss 31*j* is L1, there is a relationship where L1>L2. Distance L2 is a gap (stroke) to the point at which the plunger 3*a*' is attracted due to a magnetic force generated by the energized attraction coil 3*f* and reaches to (comes in contact with) the first boss 31*j*. The distance (stroke) L1 is necessary for the shift lever 8 to drive and for the roller clutch 6 and pinion to engage with the ring gear to start the engine. Distance L2 between the plunger 3*a*' and the second boss 32*j* is made shorter than distance (stroke) L1. As a result, a step (difference surface in level) equivalent to the height (L1−L2) occurs between the end surface of the first boss 31*j* and that of the second boss 32*j*. For example, distance L1 is set at 10 mm as is the same as in FIG. 2 and distance L2 is set at 8 mm.

When the plunger 3*a*' moves in the direction of arrow X (operating direction when power is turned on) due to a magnetic force generated by the energized attraction coil 3*f*, the plunger 3*a*' first reaches to the second boss 32*j*. Furthermore, the plunger 3*a*' continuously moves in the same direction while resisting the force of the spring 33*j*, and then stops moving when it reaches to the first boss 31*j*.

As shown in the drawing, a distance (gap) between the plunger 3*a*' and the first boss 31*j* is L1, and a distance between the plunger 3*a*' and the second boss 32*j* is L2. Because the distance L2 is shorter than the distance L1, a great attraction force affects the plunger 3*a*'. Therefore, by using a starter according to this embodiment, it is possible for the number of turns of the attraction coil 3*f* and the holding coil 3*g* of the magnetic switch 3 to be reduced thereby reducing the size of the magnetic switch 3. Furthermore, because the attraction force can be made greater, the starter can reliably work even when the battery voltage is low.

Furthermore, in a starter 10 according to this embodiment, the boss 3*j* of the magnetic switch 3 is a division structure that consists of the first boss 31*j* and the second boss 32*j* so that an axial direction step is made between both end surfaces of the first boss 31*j* and the second boss 32*j*. As a consequence, when the plunger 3*a*' operates due to an attraction force, the plunger 32*a* first comes in contact with the second boss 32*j*, and then comes in contact with the first boss 32*a*. This mechanism twice distributes the impact force generated on the boss to reduce vibration generated on the boss, thereby reducing vibrational energy transmitted to the battery-side fixed contact 3*c* and the motor-side fixed contact 3*d*. Consequently, it is possible to prevent the occurrence of the intermittent contact condition (chattering) among the above contacts and the movable contact 3*b*. The adoption of the magnetic switch 3 for a starter 10 according to this embodiment will prevent the contacts from intermittently opening and closing (chattering), which prevents the generation of the arc heat and the contacts from being welded together. As a result, it is possible to prevent damage to the motor or power-transmission parts due to continuous electrical current flow after the key switch has been turned off.

As stated above, according to this embodiment, it is possible to increase the attraction force that affects the plunger 3*a* of the magnetic switch 3, thereby making it possible to reduce the size of the magnetic switch 3. It is also possible to make the functioning of the magnetic switch 3 reliable even when the battery voltage is low. Furthermore, the chattering of the magnetic switch 3 will be eliminated, which will improve reliability.

Next, with reference to FIG. 6, the construction of a starter and a solenoid used for the starter, according to a third embodiment of the present invention, will be described. A schematic view of the starter according to this embodiment is the same as that shown in FIG. 1.

Figure 6:
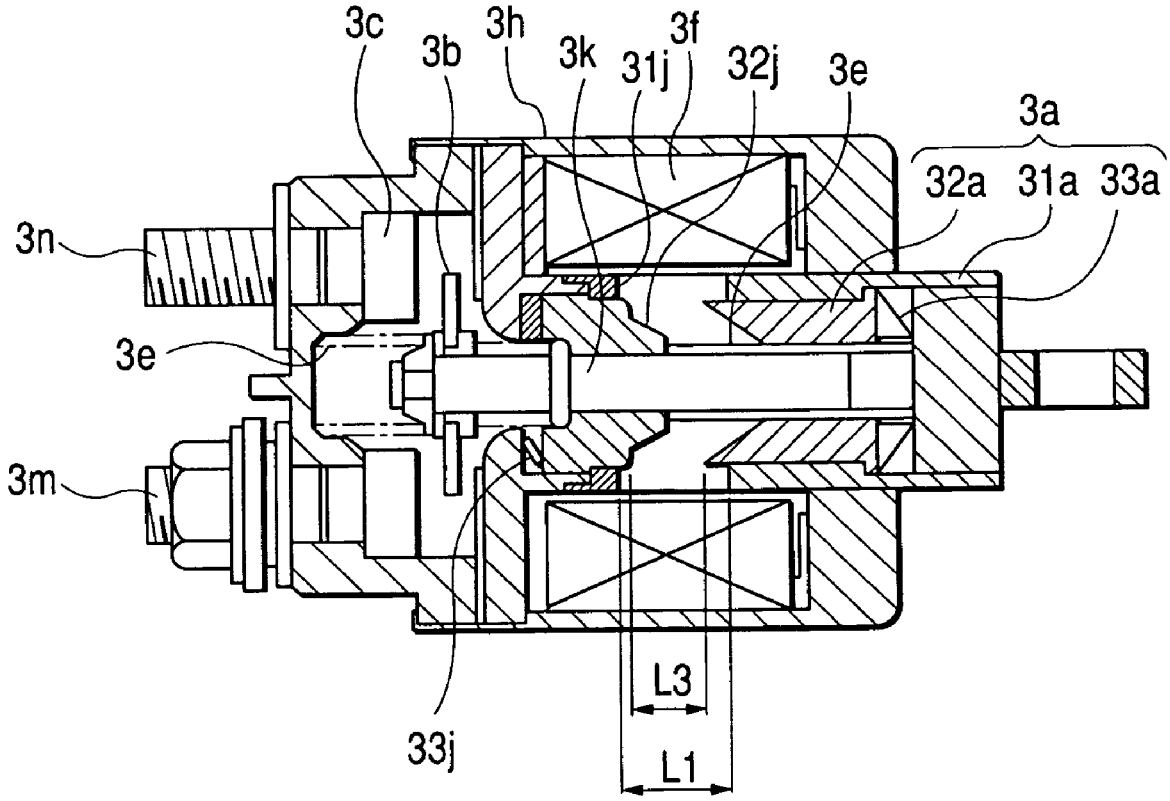
FIG. 6 is a schematic cross-sectional view that illustrates a magnetic switch used for a starter according to a third embodiment of the present invention.

FIG. 6 is a schematic cross-sectional view that illustrates a magnetic switch used for a starter according to a second embodiment of the present invention. Items in FIG. 6 are identical to those in FIG. 2 when the same alphanumeric appears.

As shown in FIG. 2, the plunger 3*a* consists of the first plunger 31*a*, the second plunger 32*a* and the spring 33*a*. Furthermore, a boss (fixed core) 3*j* consists of a first boss 31*j*, second boss 32*j* and a dish-like plate spring 33, as shown in FIG. 5. The first boss 31*j* is formed on the outer-periphery side and the second boss 32*j* is formed on the inner-periphery side. Both bosses are formed coaxially. A dish-like plate spring 33*j* is located as a shock absorber in an axial direction gap located between the first boss 31*j* and the second boss 32*j*.

Assuming that the distance between the end surface of the second plunger 32*a* and the second boss 32*j* is L3 and the distance between the end surface of the first plunger 31*a* and the first boss 31*j* is L1, there is a relationship where L1>L3. There is a step equivalent to the height (L1−L3)/2 between the end surface of the first boss 31*j* and that of the second boss 32*j* and there is also the same step between the first plunger 31*a* and the second plunger 32*a*. For example, distance L1 is set at 10 mm as is the same as in FIG. 2 and distance L2 is set at 6 mm.

As shown in the drawing, the distance between the first plunger 31*a* and the first boss 31*j* is L1, and the distance between the second plunger 32*a* and the second boss 32*j* is L3. Because the distance L3 is shorter than the distance L1 and can also be made shorter than the distance L2 shown in FIG. 2 or FIG. 5, a greater attraction force affects the plunger 3*a*. Therefore, by using a starter according to this embodiment, it is possible for the number of turns of the attraction coil 3*f* and the holding coil 3*g* of the magnetic switch 3 to be reduced thereby reducing the size of the magnetic switch 3. Furthermore, because the attraction force can be made greater, the starter can reliably work even when the battery voltage is low.

This mechanism twice distributes up the impact force generated on the boss to reduce vibration generated on the boss, thereby reducing vibrational energy transmitted to the battery-side fixed contact 3*c* and the motor-side fixed contact 3*d*. Consequently, it is possible to prevent the occurrence of the intermittent contact condition (chattering) among the above contacts and the movable contact 3*b*. The adoption of the magnetic switch 3 for a starter 10 according to this embodiment will prevent the contacts from intermittently opening and closing (chattering), which prevents the generation of the arc heat and the contacts from being welded together. As a result, it is possible to prevent damage to the motor or power-transmission parts due to continuous electrical current flow after the key switch has been turned off.

As stated above, according to this embodiment, it is possible to increase the attraction force that affects the plunger 3*a* of the magnetic switch 3, thereby making it possible to reduce the size of the magnetic switch 3. It is also possible to make the functioning of the magnetic switch 3 reliable even when the battery voltage is low. Furthermore, the chattering of the magnetic switch 3 will be eliminated, which will improve reliability.

EFFECTS OF THE INVENTION

According to the present invention, it is possible to make a small and light magnetic switch while ensuring that the magnetic switch maintains sufficient attraction force as well as to increase reliability of operations of the magnetic switch even when battery voltage is low.

What is claimed is:

1. A solenoid type drive for a switch having a fixed contact and a movable contact capable of contacting with the fixed contact and detaching therefrom, comprising:
   - an exciting coil being capable of generating magnetic force by being energized;
   - a moving core being a component of a magnetic circuit and being capable of moving in the axial direction by undergoing the magnetic force, for allowing to move the movable contact;
   - a fixed core being also a component of the magnetic circuit and being located opposite the moving core; and
   - a buffer mechanism for distributing a shock, arising from magnetic attraction of the moving core to the fixed core and transferred from the fixed core to the fixed contact at least twice.

2. A solenoid type drive according to claim 1, wherein
   - the moving core and the fixed core are constructed so that the moving core comes in contact with the fixed core while remaining a partial small gap between them when the moving core was attracted to the fixed core by energizing the exciting coil, and
   - at least one of the moving core and the fixed core has a mechanism which operates so as to decrease the partial small gap.

3. A solenoid type drive according to claim 1, wherein
   - at least one of the moving core and the fixed core comprises two or more concentric core elements, and
   - the moving core reaches to the fixed core first at one side of the core elements when the moving core is attracted to the fixed core by energizing the exciting coil, and then reaches to the fixed core at the other side of the core elements.

4. A solenoid type drive according to claim 1, wherein
   - at least one of the moving core and the fixed core is divided concentrically into two or more core elements,
   - a distance between the moving core and the fixed core at one side of the core elements, at the time of non-energizing the exciting coil, is made shorter than a distance between the moving core and the fixed core at the other side of the core elements.

5. A solenoid type drive according to claim 1, wherein
   - at least one of the moving core and the fixed core is divided into two or more core elements so that the core elements can relatively displace each other in the moving direction of the moving core,
   - at the time of non-energizing the exciting coil, two or more different distances corresponding to the core elements are placed between the fixed core and the moving core,
   - the relative displacement of the core elements occurs due to impact arisen when the moving core was magnetically attracted to the fixed core by energizing the exciting coil.

6. A starter comprising:
   - a motor for generating a rotational driving power for starting an engine,
   - a power transmission apparatus that transmits the motor's rotational driving power to the engine, and
   - a solenoid switch that comprises an exciting coil which is energized and generates magnetic force, a moving core which is a component of a magnetic circuit and is movable in the axial direction, and a fixed core which is located opposite the moving core and is also a component of the magnetic circuit, wherein
   - the power transmission apparatus is operated, by action of the solenoid switch, and the motor is energized;
   - the moving core and the fixed core are constructed so that the moving core comes in contact with the fixed core while remaining a partial small gap between them when the moving core was attracted to the fixed core by energizing the exciting coil, and
   - at least one of the moving core and the fixed core has mechanism which operates so as to decrease the partial small gap.

7. A starter according claim 6, wherein
   - the solenoid switch is equipped with a buffer mechanism for distributing the shock, which arises when the moving core was magnetically attracted to the fixed core by energizing the exciting coil, in two or more times.

8. A starter according to claim 6, wherein
   - the solenoid switch is equipped with a buffer mechanism for distributing the shock, which arises when the moving core was magnetically attracted to the fixed core by energizing the exciting coil, in two or more times,
   - the buffer mechanism is constructed by the moving core divided into two or more core elements, and the core elements can relatively displace each other in the moving direction of the moving core.

9. A starter according to claim 6, wherein the solenoid switch is equipped with a buffer mechanism for distributing the shock, which arises when the moving core was magnetically attracted to the fixed core by energizing the exciting coil, in two or more times, the buffer mechanism is constructed by the moving core divided into two or more core elements, and the core elements can relatively displace in the moving direction of the moving core, the moving core elements are arranged so that their end surfaces opposite to the fixed core have a difference in level in the axial direction when the moving core elements are attracted to the fixed core.

10. A starter according to claim 6, wherein the solenoid switch is equipped with a buffer mechanism for distributing the shock, which arises when the moving core was magnetically attracted to the fixed core by energizing the exciting coil, in two or more times, the buffer mechanism is constructed by the moving core divided into two or more core elements, and the core elements can relatively displace in the moving direction of the moving core, and the moving core is equipped with a shock absorber using an elastic body that elastically deforms as the relative displacement of the core elements.

11. A starter according to claim 6, wherein the solenoid switch is equipped with a buffer mechanism for distributing the shock, which arises when the moving core was magnetically attracted to the fixed core by energizing the exciting coil, in two or more times, the buffer mechanism is constructed by the fixed core divided into two or more core elements, and the core elements can relatively displace in the moving direction of the moving core.

12. A starter according to claim 6, wherein the solenoid switch is equipped with a buffer mechanism for distributing the shock, which arises when the moving core was magnetically attracted to the fixed core by energizing the exciting coil, in two or more times, the buffer mechanism is constructed by the fixed core divided into two or more core elements, and the core elements can relatively displace each other in the moving direction of the moving core, and the fixed core elements are arranged so that their end surfaces opposite to the moving core have a difference in level in the axial direction.

13. A starter according to claim 6, wherein the solenoid switch is equipped with a buffer mechanism for distributing the shock, which arises when the moving core was magnetically attracted to the fixed core by energizing the exciting coil, in two or more times, the buffer mechanism is constructed by the fixed core divided into two or more core elements, and the core elements can relatively displace in the moving direction of the moving core, and the fixed core is equipped with a shock absorber using an elastic body that elastically deforms as the relative displacement of the core elements.

14. A starter comprising:

a motor for generating a rotational driving power for starting an engine, a power transmission apparatus that transmits the motor's rotational driving power to the engine, and a solenoid switch that comprises an exciting coil which is energized and generates magnetic force, a moving core which is a component of a magnetic circuit and is movable in the axial direction, and a fixed core which is located opposite the moving core and is also a component of the magnetic circuit, wherein the power transmission apparatus is operated, by action of the solenoid switch, and the motor is energized;

at least one of the moving core and the fixed core comprises two or more core elements, and the moving core reaches to the fixed core first at one side of the core elements when the moving core is attracted to the fixed core by energizing the exciting coil, and then reaches to the fixed core at the other side of the core elements.

15. A starter comprising:

a motor for generating a rotational driving power for starting an engine, a power transmission apparatus that transmits the motor's rotational driving power to the engine, and a solenoid switch that comprises an exciting coil which is energized and generates magnetic force, a moving core which is a component of a magnetic circuit and is movable in the axial direction, and a fixed core which is located opposite the moving core and is also a component of the magnetic circuit, wherein the power transmission apparatus is operated, by action of the solenoid switch, and the motor is energized;

at least one of the moving core and the fixed core is divided concentrically into two or more core elements, a distance between the moving core and the fixed core at one side of the core elements, at the time of non-energizing the exciting coil, is made shorter than a distance between the moving core and the fixed core at the other side of the core elements.

16. A starter comprising:

a motor generating a rotational driving power for starting an engine, a power transmission apparatus that transmits the motor's rotational driving power to the engine, and a solenoid switch that comprises an exciting coil which is energized and generates magnetic force, a moving core which is a component of a magnetic circuit and is movable in the axial direction, and a fixed core which is located opposite the moving core and is also a component of the magnetic circuit, wherein the power transmission apparatus is operated, by action of the solenoid switch, and the motor is energized;

at least one of the moving core and the fixed core is divided into two or more core elements so that the core elements can relatively displace each other in the moving direction of the moving core, at the time of non-energizing the exciting coil, two or more different distances corresponding to the core elements are placed between the fixed core and the moving core, the relative displacement of the core elements occurs due to impact arisen when the moving core was magnetically attracted to the fixed core by energizing the exciting coil.

17. A starter comprising:

a motor for generating a rotational driving power for starting an engine;

a transmission apparatus for transmitting the motor's rotational driving power to the engine;

a switch having a fixed contact and a movable contact capable of contacting with the fixed contact and detaching, for making the passage of electric current from a power supply to the motor and interrupting thereof;

a solenoid type drive for moving the movable contact toward or away from the fixed core and for moving a pinion of the transmission apparatus toward or away from a ring gear of the engine;

wherein the solenoid type drive comprising:

an exciting coil being capable of generating magnetic force by being energized;

a moving core being a component of a magnetic circuit and being capable of moving in the axial direction by undergoing the magnetic force, for allowing to move the movable contact;

a fixed core being also a component of the magnetic circuit and being located opposite the moving core; and a buffer mechanism for distributing a shock arising from magnetic attraction of the moving core to the fixed core and transferred from the fixed core to the fixed contact at least twice.

* * * * *